US011499514B2

(12) United States Patent
Han et al.

(10) Patent No.: US 11,499,514 B2
(45) Date of Patent: Nov. 15, 2022

(54) HIGH PRESSURE PUMP FOR VEHICLE

(71) Applicant: HYUNDAI KEFICO CORPORATION, Gyeonggi-do (KR)

(72) Inventors: Kyung Chul Han, Gyeonggi-do (KR); Hyeong Kyun Park, Gyeonggi-do (KR); Jin Sung Kim, Seoul (KR)

(73) Assignee: Hyundai Kefico Corporation, Gyeonggi-do (KR)

( * ) Notice: Subject to any disclaimer, the term of this patent is extended or adjusted under 35 U.S.C. 154(b) by 0 days.

(21) Appl. No.: 17/465,189

(22) Filed: Sep. 2, 2021

(65) Prior Publication Data

US 2022/0065206 A1 Mar. 3, 2022

(30) Foreign Application Priority Data

Sep. 3, 2020 (KR) ..... 10-2020-0112137

(51) Int. Cl.

| | |
|---|---|
| ***F02M 59/44*** | (2006.01) |
| ***F02M 63/00*** | (2006.01) |
| ***F02M 55/02*** | (2006.01) |
| ***F02M 59/10*** | (2006.01) |

(52) U.S. Cl.

CPC ..... *F02M 59/442* (2013.01); *F02M 59/10* (2013.01); *F02M 63/0054* (2013.01); *F02M 55/025* (2013.01)

(58) Field of Classification Search

CPC .. F02M 59/442; F02M 59/10; F02M 63/0054; F02M 55/025

USPC ..... 123/446

See application file for complete search history.

(56) References Cited

U.S. PATENT DOCUMENTS

2016/0377042 A1* 12/2016 McCrindle ..... F04B 1/0408 92/86
2018/0135581 A1* 5/2018 Usui ..... F02M 59/485

FOREIGN PATENT DOCUMENTS

DE 102014214282 A1 * 1/2016 ..... F02M 59/442
WO WO-2007080739 A1 * 7/2007 ..... F02M 59/102
WO WO-2019160533 A1 * 8/2019 ..... F02M 37/043

* cited by examiner

*Primary Examiner* — Mahmoud Gimie
(74) *Attorney, Agent, or Firm* — Fox Rothschild LLP

(57) ABSTRACT

A high pressure pump includes a housing with a chamber formed inside and a flow control valve and a discharge check valve installed in the chamber; a piston installed to operate up and down in an assembly hall formed in the housing to compress fuel in the chamber to a high pressure; a cylinder forming a gap between an inner circumferential surface and the piston and guiding reciprocation of the piston; and a support member seated on a stepped surface of the housing to surround an outside of the cylinder and configured to elastically support the housing and the cylinder, thereby reducing friction while preventing fuel leakage between the piston and the cylinder.

8 Claims, 8 Drawing Sheets

HIGH PRESSURE PUMP FOR VEHICLE

CROSS-REFERENCE TO RELATED APPLICATION(S)

This application claims under 35 U.S.C. § 119 the benefit of Korean Patent Application No. 10-2020-0112137 filed on Sep. 3, 2020, the entire contents of which are incorporated herein by reference.

BACKGROUND

(a) Technical Field

The present disclosure relates to a high pressure pump, more particularly, to the high pressure pump provided with a support member between a housing and a cylinder to prevent fuel leakage between a piston and the cylinder and prevent the piston from sticking to the cylinder.

(b) Description of the Related Art

A high pressure pump is connected to a fuel rail, and a low pressure pump is installed inside a fuel tank.

Fuel is first compressed by the low pressure pump to be pumped to the high pressure pump through a fuel hose, is compressed again at a high pressure in the high pressure pump to be supplied to the fuel rail and is injected from the fuel rail to a combustion chamber through each injector.

As shown in FIG. 1 (RELATED ART), the high pressure pump is provided with a piston 2 in a center of a body 1. An upper portion of the piston 2 protrudes somewhat into a chamber 1*a* formed inside the body 1, and a flow control valve 3 and a discharge check valve 4 are installed on either side of the chamber 1*a*. An outlet 5 is provided at a rear end of the discharge check valve 4.

A damper 6 for reducing pulsation is installed over the body 1, and an inlet 7 is formed on one side of the damper 6.

A flow hole 1*b* is formed between the damper 6 and the flow control valve 3, the flow hole 1*b* is connected to an inlet of the flow control valve 3, and an outlet of the flow control valve 3 is connected to the chamber 1*a*.

The flow control valve 3 typically is an electronic control valve using a solenoid and can manipulate the flow supplied to the chamber 1*a* by controlling the valve opening.

The piston 2 is constantly receiving a force to return downward by a return spring 8 and is configured to reciprocate up and down in conjunction with a cam of a camshaft (not shown).

The fuel introduced into the inlet 7 flows into the chamber 1*a* through the flow hole 1*b* via the damper 6. The fuel is compressed by the piston 2 in the chamber 1*a* and discharged to the outlet 5 through the discharge check valve 4.

The piston 2 is operated up and down and continued operation of the piston 2 enables a supply of high pressure fuel to the fuel rail, thereby enabling direct injection of the high pressure fuel into the chamber 1*a* through an injector.

A cylinder 9 mounted in the body 1 is provided for stable operation of the piston 2. The cylinder 9 is provided to surround the piston 2 and forms a gap to the piston 2 to allow an up/down operation of the piston 2.

However, when the pressure of the high pressure pump rises, there may be an increase in an amount of fuel leakage through a gap between the piston and the cylinder, thereby reducing discharge efficiency.

In addition, generation of a lateral force during the up/down operation of the piston causes another problem in that the piston may become stuck to one side of the cylinder in the direction of the lateral force generation. In particular, there may be a problem in that a risk of sticking increased as the pressure of the high pressure pump rises.

In addition, there may be a further problem in that the risk of sticking between the piston and the cylinder increases when the gap between the piston and the cylinder is reduced to prevent lowering of the discharge efficiency caused by the leakage. In addition, securing the gap between the piston and the cylinder to prevent sticking may increase the leakage amount, thereby reducing the discharge efficiency.

SUMMARY

The present disclosure provides a high pressure pump configured to reduce an amount of fuel leaking through a gap between a piston and a cylinder and prevent the piston from sticking to one side of the cylinder even when a lateral force is generated during an up/down operation of the piston.

The object of the present disclosure is not limited thereto, and other objects not mentioned will be clearly understood by those skilled in the related art from the following description.

In one aspect, a high pressure pump including a housing with a chamber formed inside and a flow control valve and a discharge check valve installed in the chamber, a piston installed to reciprocate in an assembly hall formed in the housing to compress the fuel in the chamber to high pressure, a cylinder forming a gap between an inner circumferential surface and the piston and guiding reciprocation of the piston, and a support member seated on a stepped surface of the housing to surround the outside of the cylinder and configured to elastically support the housing and the cylinder may be provided.

The support member may include a body formed in a cylindrical shape and inserted between the housing and the cylinder and a first end support protruding inward along the circumference from one end of the body to support one side of the cylinder with a protruding end in close contact with the piston to support the housing and the piston.

In addition, the support member may further include a second end support protruding inward along the circumference from the body to support the cylinder with the protruding end spaced apart from the piston.

In addition, the cylinder may include a hollow-shaped extension formed to axially protrude from the cylinder and positioned between the second end support and the piston.

In addition, the high pressure pump may include a hollow-shaped fixing member mounted in an assembly hole to support the second end support member in the axial direction of the piston, wherein the inner diameter of the fixing member is smaller than the outer diameter of the cylinder and larger than the outer diameter of the extension.

In addition, the high pressure pump may further include an auxiliary support member formed in a hollow shape and inserted into the assembly hole to axially support the support member and the cylinder, the inner side being spaced apart from the piston.

In addition, the high pressure pump may further include a fixing member mounted in the assembly hole to support in the axial direction of the piston the end of the support member opposite the end supported by the stepped surface.

The fixing member may be provided with space to the cylinder or a piston in the radial direction.

In addition, the assembly hole is formed by stepping from, and with a larger diameter than, the insertion hole of the housing to which the piston is installed with a gap, and is formed in a cylindrical shape with the axis of piston as the center axis.

According to the present disclosure, there is an effect of reducing the fuel amount leaking through a gap between a piston and a cylinder, preventing the piston from sticking to one side of the cylinder even when a lateral force is generated during an up/down operation of the piston, and reducing operation loss caused by friction between the piston and the cylinder.

In addition, the up/down operation of the piston is guided through the support member and the cylinder so that the piston operates more stably, and there is an effect of enhancing the discharge efficiency of the high pressure pump.

DETAILED DESCRIPTION

Figure 1:
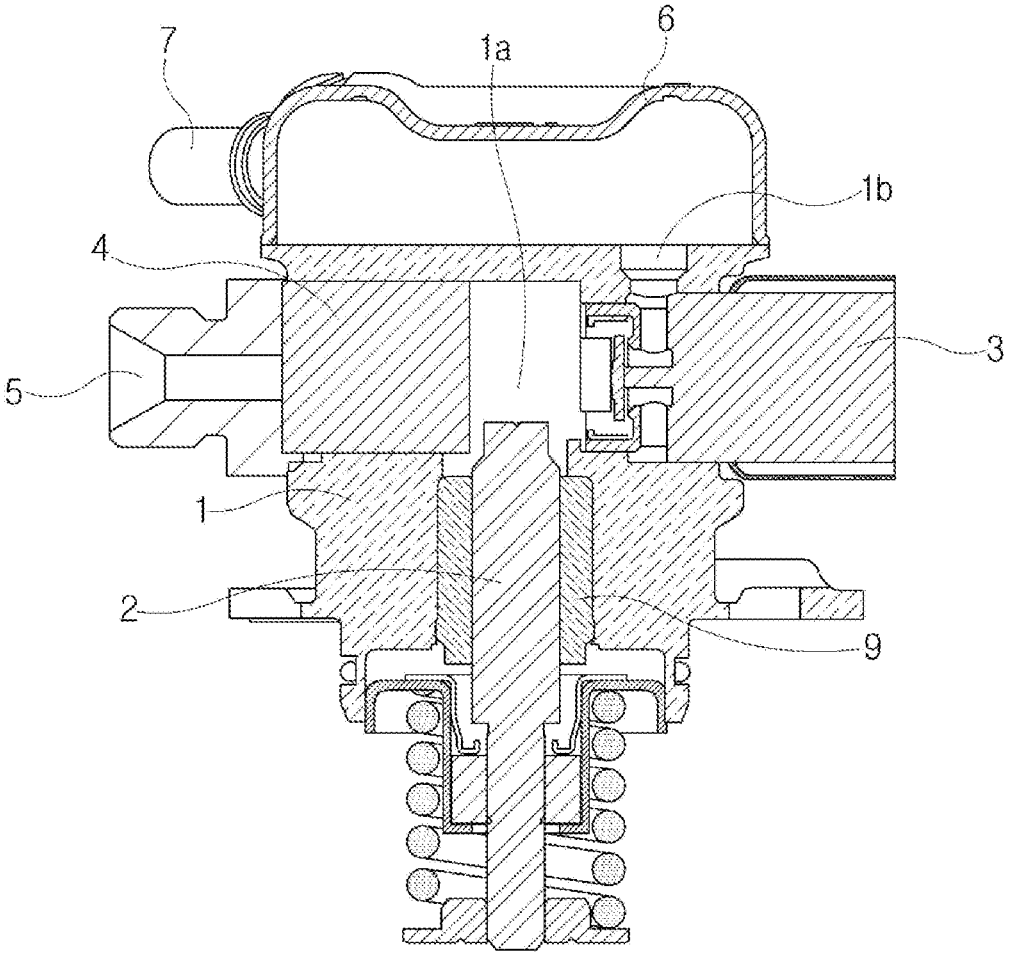
FIG. 1 (RELATED ART)
FIG. 1 (RELATED ART) is a longitudinal view of a high pressure pump according to the related art.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The terminology used herein is for the purpose of describing particular embodiments only and is not intended to be limiting of the disclosure. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Throughout the specification, unless explicitly described to the contrary, the word "comprise" and variations such as "comprises" or "comprising" will be understood to imply the inclusion of stated elements but not the exclusion of any other elements. In addition, the terms "unit", "-er", "-or", and "module" described in the specification mean units for processing at least one function and operation, and can be implemented by hardware components or software components and combinations thereof.

Further, the control logic of the present disclosure may be embodied as non-transitory computer readable media on a computer readable medium containing executable program instructions executed by a processor, controller or the like. Examples of computer readable media include, but are not limited to, ROM, RAM, compact disc (CD)-ROMs, magnetic tapes, floppy disks, flash drives, smart cards and optical data storage devices. The computer readable medium can also be distributed in network coupled computer systems so that the computer readable media is stored and executed in a distributed fashion, e.g., by a telematics server or a Controller Area Network (CAN).

Hereinafter, exemplary embodiments of the present disclosure will be described in detail with reference to the accompanying drawings. It should be noted that, in assigning reference numerals to the components in each drawing, the same components have the same numerals as far as possible even when the components are displayed in different drawings. In addition, when it is determined that a specific description of a related configuration or function already known may obscure the gist of the present disclosure, the detailed description thereof will be omitted in describing the present disclosure.

Figure 2:
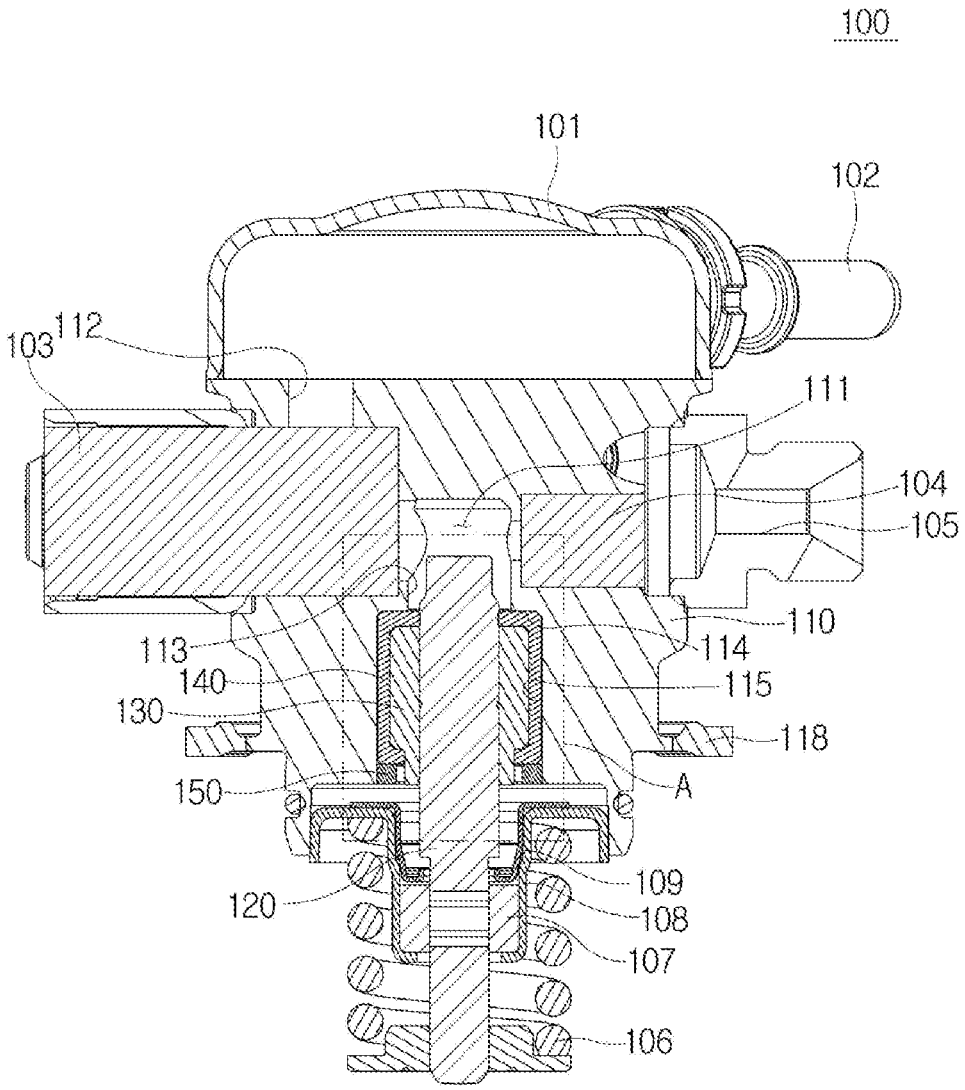
FIG. 2 is a longitudinal view of a high pressure pump according to an embodiment of the present disclosure.
Figure 3:
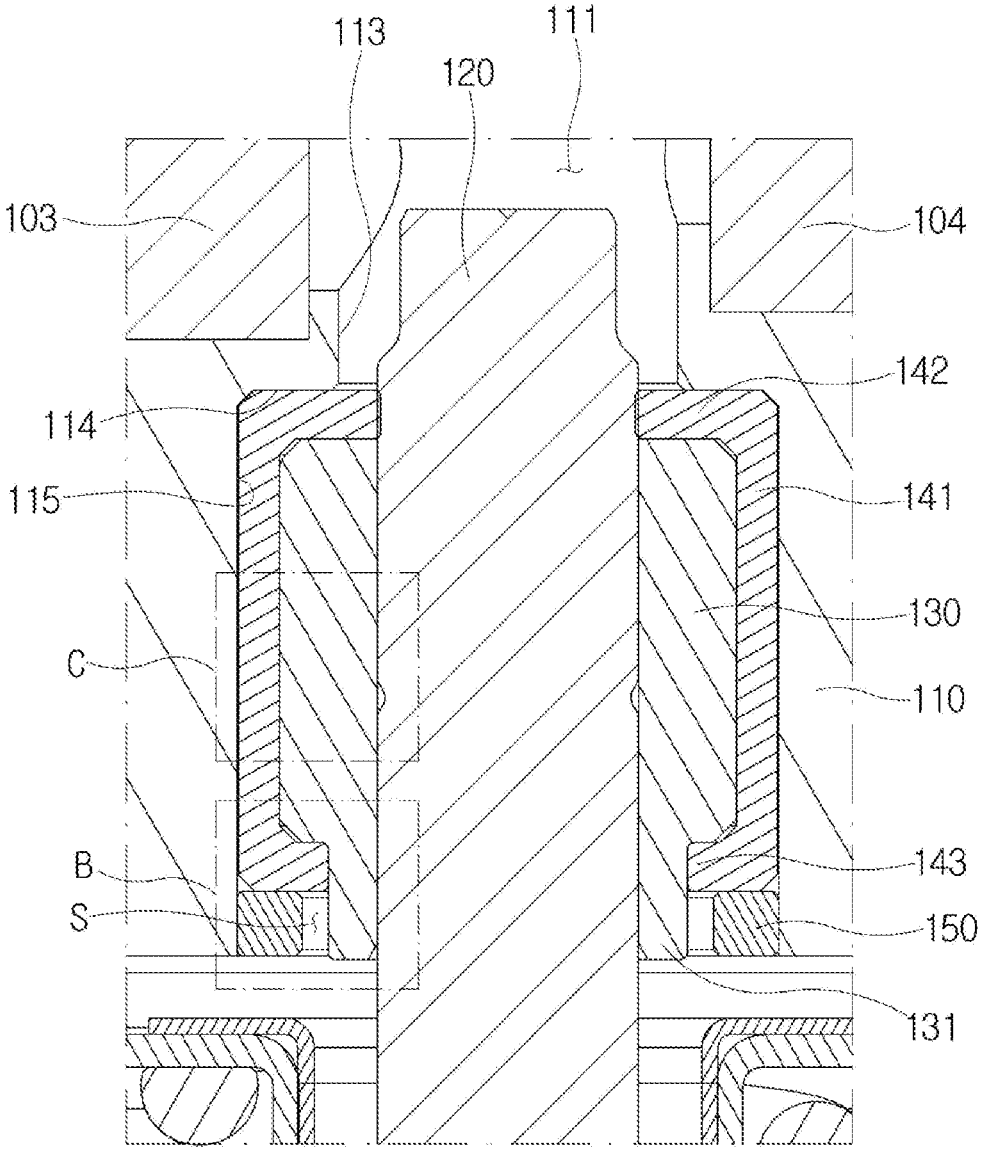
FIG. 3 is an enlarged view of part A of FIG. 2.
Figure 4:
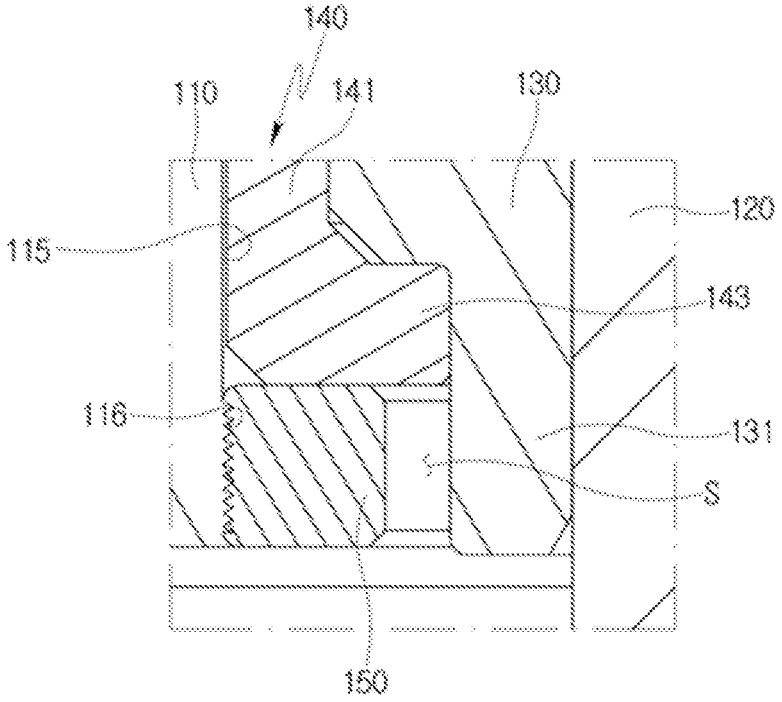
FIGS. 4 and 5 are enlarged views of part B of FIG. 3 to show an example of a fixing member fixed to a pressure pump according to an embodiment of the present disclosure.
Figure 5:
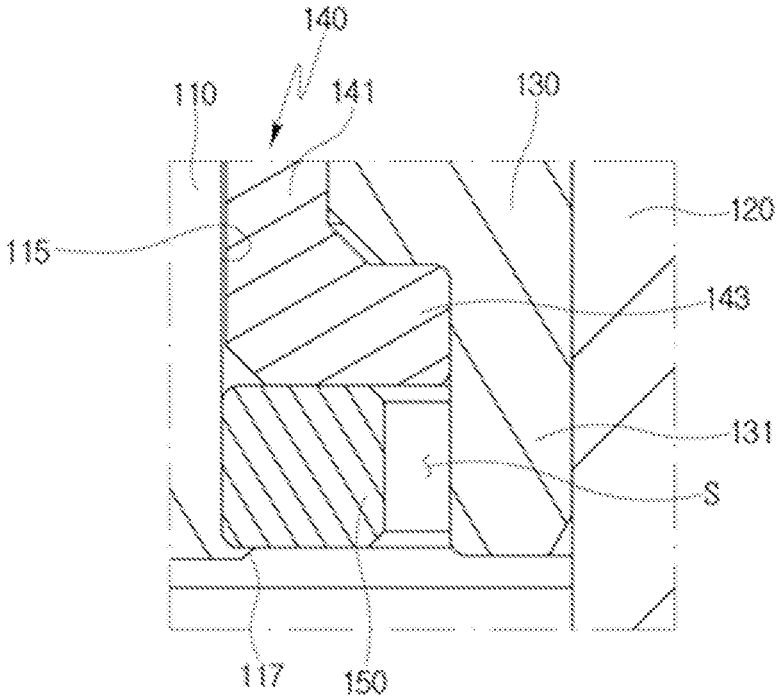
Figure 6:
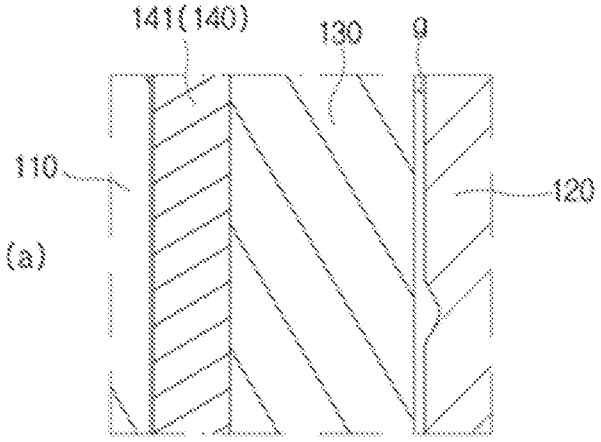
FIGS. 6 to 8 are enlarged views of part C of FIG. 3 to show a state of a piston, a cylinder, and a support member when a lateral force is generated in the piston of a high pressure pump according to an embodiment of the present disclosure.
Figure 7:
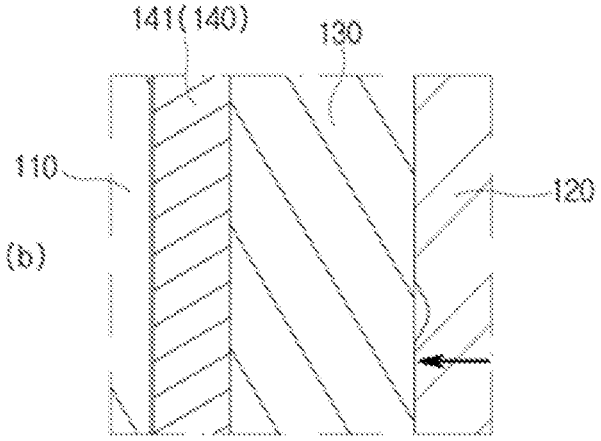
Figure 8:
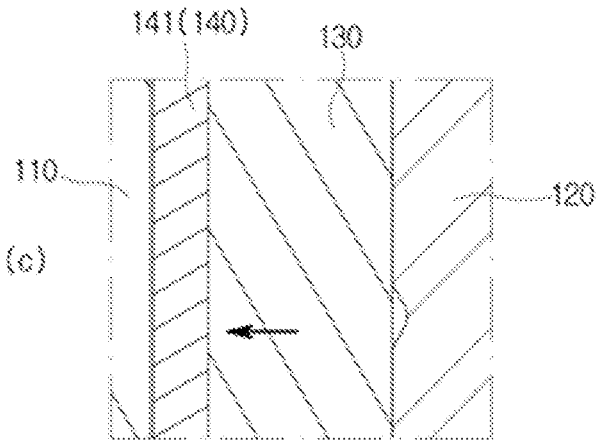
Figure 9:
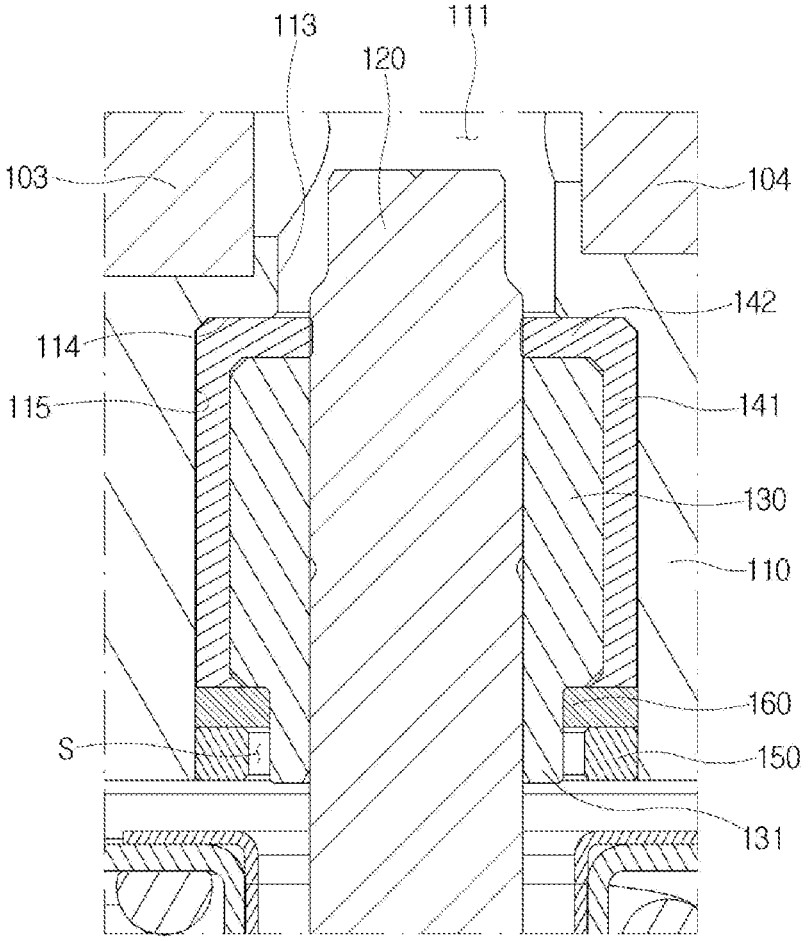
FIG. 9 is a longitudinal view showing a part of a pressure pump according to another embodiment of the present disclosure.

FIG. 2 is a longitudinal view of a high pressure pump according to an embodiment of the present disclosure, FIG. 3 is an enlarged view of part A of FIG. 2, FIGS. 4 and 5 are enlarged views of part B of FIG. 3 to show an example of a fixing member fixed to a pressure pump according to an embodiment of the present disclosure, FIGS. 6 to 8 are enlarged views of part C of FIG. 3 to show a state of a piston, a cylinder, and a support member when a lateral force is generated in the piston of a high pressure pump according to an embodiment of the present disclosure, and FIG. 9 is a longitudinal view showing a part of a pressure pump according to another embodiment of the present disclosure.

As shown in FIG. 2, a high pressure pump 100 according to an embodiment of the present disclosure includes a housing 110 with a chamber 111 formed inside and a flow control valve 103 and a discharge check valve 104 installed in the chamber 111, a piston 120 installed to reciprocate in an assembly hall 115 formed in the housing 110 to compress the fuel in the chamber 111 to a high pressure, a cylinder 130 forming a gap between an inner circumferential surface and the piston 120 and guiding reciprocation of the piston 120, and a support member 140 seated on a stepped surface 114 of the housing 110 to surround the outside of the cylinder 130 and configured to elastically support the housing 110 and the cylinder 130.

In addition, in describing the present disclosure in detail, for the convenience of description, the chamber 111 side of the piston 120 will be designated as an upward direction and the return spring 106 side of the piston 120 will be designated as a downward direction.

The high pressure pump 100 compresses the fuel to supply the same to a fuel rail and is provided with a damper 101, the flow control valve 103, the discharge check valve 104, and the piston 120 installed in the housing 110.

The housing 110 is provided with the piston 120 in an insertion hole 113 formed in a center, and the chamber 111 serving as a space in which the fuel is compressed is formed over the piston 120.

The damper 101 is provided with an inlet 102 formed on one side and is installed over the housing 110 to damp pulsation.

The flow control valve 103 is installed on one side of the chamber 111 to be connected to the damper 101 through a flow hole 112 and introduces the fuel into the chamber 111. The flow control valve 103 is an electronic control valve using a solenoid and manipulates a flow rate supplied to the chamber 111 by controlling the valve opening.

The discharge check valve 104 is installed on the other side of the chamber 111 and discharges the compressed fuel from the chamber 111 through an outlet 105.

The piston 120 is installed to reciprocate in an assembly hole 115 formed in the housing 110 to compress the fuel introduced into the chamber 111 to high pressure. In addition, the piston 120 is constantly receiving a force to return downward by a return spring 106 and is installed to reciprocate up and down in conjunction with a cam of a camshaft (not shown).

In addition, a cylinder 130 is installed between the housing 110 and the piston 120 to guide the up/down operation of the piston 120.

In addition, a seal 107 surrounding the outside of a lower portion of the piston 120 is provided to prevent fuel leakage to the outside of the high pressure pump 100.

A seal carrier 108 and a seal fixing member 109 installed in the housing 110 to install and fix the seal 107 are provided.

The seal carrier 108, supported by one side of the return spring 106, supports the seal 108 upward, and the seal fixing member 109 is inserted from above the seal 107.

The seal fixing member 109 is inserted into the seal carrier 108 to suppress an upward movement of the seal 107.

In particular, a hydraulic pump of the present disclosure is provided with a support member 140 between the housing 110 and the cylinder 130 to stably guide the reciprocation of the piston 120 while preventing the fuel leakage from the chamber 111.

The housing 110 is provided with the piston 120 installed in the insertion hole 113 and a stepped surface 114 and an assembly hole 115 are formed by stepping from, and with a larger diameter than, the insertion hole 113.

The insertion hole 113 is formed between the chamber 111 and the insertion hole 113 of the housing 110 and the piston 120 is installed with a gap.

In addition, the assembly hole 115 has a diameter larger than the diameter of the insertion hole 113 and is formed in a cylindrical shape with the piston 120 axis as the center axis, and the support member 140 to be described below is inserted therein.

In particular, the support member 140 may be easily inserted when the housing 110 is mounted on a cylinder head even if the assembly hole 115 is deformed, and the thickness of the cylinder 130 and the piston 120 may be secured and space for installing the support member 140, the cylinder 130, and the piston 120 in the housing 110 may be secured so that the reciprocation of the piston 120 is stably guided.

In particular, when a flange 118 provided on the outside of the housing 110 to mount the housing 110 on the cylinder head of a vehicle is mounted on the cylinder head employing a fastening member, the fastening force of the fastening member bends and deforms the flange 118, thereby deforming the assembly hole 115 to shrink. The assembly hole 115 is preferably formed with a diameter larger than the diameter of the insertion hole 13 so that the support member 140 and the cylinder 130 may be assembled even if the assembly hole 115 is deformed.

The cylinder 130 is formed in a hollow cylindrical shape and installed to form a gap between the inner circumferential surface and the piston 120 and guides the reciprocation of the piston 120.

The cylinder 130 secures an area for guiding the piston 120, thereby enhancing the discharge efficiency of the high pressure pump 100 and reducing the leakage flowing out of the chamber 111.

The support member 140 is inserted into the assembly hole 115 of the housing 110 to surround the outside of the cylinder 130, and then supported by the stepped surface 114, is installed between the housing 110 and the cylinder 130.

In addition, the housing 110 and the cylinder 130 are formed of a solid material, and the support member 140 is formed of a material more elastic than the material of the housing 110 and the cylinder 130.

For example, the housing 110 and the cylinder 130 may be formed of stainless steel material, and the support member 140 may be formed of polytetrafluoroethylene (PTFE), polyetheretherketone (PEEK), polyamide (PA) material, but is not limited thereto.

Accordingly, the support member 140 is formed of an elastic material to elastically support the housing 110 and cylinder 130, thereby preventing the risk of the piston 120 sticking to the cylinder 130 even when a lateral force is applied during the up/down operation of the piston 120 and reducing the friction between the piston 120 and the cylinder 130.

The support member 140 includes a body 141, a first end support 142, and a second end support 143, the first and second end supports 142, 143 arranged on opposite ends of the body 141.

The body 141 is formed in a hollow cylindrical shape and inserted between the housing 110 and the cylinder 130.

The first end support 142 protrudes inward along a circumference of the cylinder 130 from one end of the body 141 to support one side of the cylinder 130.

In addition, the protruding end of the first end support 142 has an inner diameter smaller than the inner diameter of the cylinder 130 and protrudes inward farther than the cylinder 130 so that the first end support 142 is in close contact with the piston 120. In addition, the first end support 142 may be assembled in a compressed state when it is assembled with the piston 120 to elastically support the piston 120.

The first end support 142 elastically supports the piston 120 while applying a restoring force to the outside so that the first end support 142 provides a seal function of preventing the fuel from leaking from the chamber 111. In particular, the first end support 142 directly supports the housing 110 and the piston 120 to provide a supporting force so that the piston 120 is positioned at the center of the assembly hole 115 when the piston 120 is tilted to one side by a lateral force.

That is, the cylinder 130 is installed to form a gap in order to guide the up/down operation of the piston 120. In addition, the first end support 142 of the support member 140 surrounding the cylinder 130 blocks and seals the gap to the chamber 111 in close contact with the piston 120 so that the fuel leakage from the chamber 111 is prevented.

At this time, the support member 140 may be formed of a material containing Teflon or the inner surface of the protruding end of the first end support 142 is coated with Teflon to reduce the friction resistance so that the up/down operation of the piston 120 may be stably performed even if the first end support 142 is in close contact with the piston 120.

The second end support 143 protrudes inward along the circumference from the other end of body 141 to support the other side of the cylinder 130.

In addition, the protruding end of the second end support 143 is spaced apart from the piston 120 so that an extension 131, to be described below, may be formed in the cylinder 130 and supports the outer circumferential surface of the extension 131 of the cylinder 130.

The cylinder 130 includes the extension 131 formed to axially protrude from the other end that the second end support 143 supports and positioned between the second end support 143 and the piston 120 to secure an area for guiding the piston 120.

The extension 131 is formed in a hollow shape to have the same inner diameter as the inner diameter of the cylinder 130 and is formed to have the same gap to the piston 120.

In addition, the extension 131 has an outer circumferential surface formed by stepping from, and with a smaller diameter than, the outer circumferential surface of the cylinder 130 and is supported by the second end support 143 of the support member 140.

The first end support 142 and the second end support 143 may be respectively formed on the upper side or lower side of the body 141. For example, as shown in the drawing, the first end support 142 may be formed on the upper side of the body 141 and the second end support 143 may be formed on the lower side of the body 141, on which the description will be based for the convenience of description.

However, the second end support 143 may be formed on the upper side of the body 141 and the first end support 142 may be formed on the lower side of the body 141.

As shown in the drawing, the first end support 142 is formed on the upper side of the body 141 and inserted between the stepped surface 114 and the cylinder 130 to support the housing 110 and the cylinder 130. The second end support 143 is inserted between the fixing member 150, to be described below, and the cylinder 130 to support the fixing member 150 and the cylinder 130.

In addition, the first end support 142 is formed on the upper side of the body 141 so that the axial distance to the seal surrounding the outside of the lower portion of the piston 120 increases to be able to guide the up/down operation of the piston 120 more stably.

In addition, the cylinder 130 and the support member 140 may be respectively manufactured as separate components and then assembled or may be formed by overmolding the outside of the cylinder 130 with the support member 140.

When the cylinder 130 and the support member 140 are respectively manufactured as separate components, the support member 140 is placed on the outside the cylinder 130 with the other end spread apart, and then, the second end support 143 is seated on the extension 131 to be assembled.

At this time, the support member 140 is preferably formed of a material that may increase the inner diameter of the second end support 143.

In addition, the inner edge and the outer edge of the support member 140 are preferably rounded or chamfered so that the support member is not damaged by deformation during assembly. In addition, the outer edge of the cylinder 130 is also preferably rounded or chamfered so that the support member 140 may be easily assembled without resistance.

The fixing member 150 is provided to fix the support member 140 to the housing 110 and is mounted on the inner circumference surface of the housing 110 to support in the axial direction of the piston 120 the end opposite the end supported by the stepped surface 114 of the support member 140.

The fixing member 150 is provided in a ring shape and coupled to the lower end of the assembly hole 115 of the housing 110 to fix the support member 140 to the housing 110.

In addition, the fixing member 150 axially supports the support member 140 and fixes the same to the housing 110 in a compressed state, so that the slipping of the support member 140 is prevented and the support member 140 stably fixes the cylinder 130.

At this time, the fixing member 150 is provided with space S to the cylinder 130 or the piston 120 in the radial direction.

That is, when the cylinder 130 or the extension 131 is not inserted between the fixing member 150 and the piston 120, the space S is provided between the fixing member 150 and the piston 120. In addition, when the extension 131 is provided between the fixing member 150 and the piston 120, the space S is provided between the fixing member 150 and the extension 131.

The space S allows the piston 120 or the piston 120 together with the cylinder 130 to slide in the radial direction when a lateral force is generated during the up/down operation of the piston 120.

If the fixing member 150 is fastened with a gap to the piston 120 or fastened with a gap to the extension 131, the risk of a collision between the piston 120, or the extension 131, and the fixing member 150 and sticking between the piston 120 and the cylinder 130 increases when a lateral force is generated during the up/down operation of the piston 120.

Accordingly, the fixing member 150 is provided with the space S so that the piston 120 and the cylinder 130 may sway when a lateral force is applied between the fixing member 150 and the cylinder 130 or the piston 120 during the up/down operation of the piston 120 and the piston 120 moves to return to the center of the assembly hole 115.

The inner diameter of the fixing member 150 is preferably formed larger than the outer diameter of the extension 131 to form the space S.

In addition, the inner diameter of the fixing member 150 is preferably formed smaller than the outer diameter of the cylinder 130 lest the cylinder 130 should be dislodged inward of the fixing member 150.

The fixing member 150 may be fixedly screwed to the housing 110 or may be press-fitted to be fastened by caulking, which will be described with reference to FIGS. 4 and 5.

According to FIG. 4, a screw portion 116 is formed at the lower end portion of the assembly hole 115 of the housing 110, and the fixing member 150 is fastened to the screw portion 116 to fix the support member 140.

However, the support member 140 is axially compressed by the fixing member 150 once the fixing member 150 is fastened to the screw portion 116.

In addition, according to FIG. 5, the fixing member 150 is press-fitted into the assembly hole 115 of the housing 110 to axially compress the support member 140 and fixed by caulking such that the end of the assembly hole 115 of the housing 110 protrudes inward.

At this time, the end of the assembly hole 115 of the housing 110 is provided with a caulking portion 117 formed in the caulking process, and the fixing member 150 is fixed to the housing 110.

FIGS. 6 to 8 are views exaggeratingly showing the gap between the cylinder 130 and the piston 120 and the extent of the support member 140 compression for the convenience of description, and the effect of the support member 140 will be described below with reference to the drawings.

FIG. 6 is a view showing a state before a lateral force is generated to the piston 120. A gap g is formed between the piston 120 and the cylinder 130 and the first end support 142 of the support member 140 is in close contact with the piston 120.

Here, when a lateral force is generated during the up/down operation of the piston 120, the piston 120 moves to one side of the inner circumferential surface of the cylinder 130, the gap g disappears, and the first end support 142 is radially compressed as shown in FIG. 7.

In addition, when a greater lateral force is generated, as shown in FIG. 8, the piston 120 applies a force to the cylinder 130, the cylinder 130 compresses one side of the support member 140, and the piston 120 and the cylinder 130 move to one side.

That is, a part of the force applied by the piston 120 to the cylinder 130 is absorbed as the support member 140 is elastically compressed, and the cylinder 130 supports the piston 120 with the remaining force only so that the risk of sticking between the cylinder 130 and the piston 120 is prevented to reduce friction and the piston 120 returns to the center of the assembly hole 115.

If the support member 140 is not provided and the cylinder 130 is inserted into the housing 110 as before, when the piston 120 applies a force to the cylinder 130, the piston 120 supports the cylinder 130 with a counterforce so that the piston 120 and the cylinder 130 are stuck, the friction between the piston 120 and the cylinder 130 inevitably increases, and the discharge efficiency of the high pressure pump 100 is reduced.

Accordingly, according to the present disclosure, when the support member 140 is provided and the piston 120 applies a force to the cylinder 130, the cylinder 130 may move to one side while compressing the support member 140 and absorb a part of the force applied by the piston 120 to the cylinder 130 and the compressed first end support 142 of the support member 140 applies a return force directly to the piston 120 so that the risk of sticking may be prevented and the friction between the piston 120 and the cylinder 130 may be reduced.

In addition, the support member 140 is provided between the housing 110 and the cylinder 130 so that the risk of sticking may be prevented and the gap between the cylinder 130 and the piston 120 may be designed to be narrower, thereby reducing the fuel leakage caused by the gap between the cylinder 130 and the piston 120.

In addition, when the cylinder 130 and the support member 140 are manufactured as separate components and assembled, the second end support 143 of the support member 140 may be manufactured as a separate component for easy assembly.

That is, the support member 140 consists of the body 141 and the first end support 142, and an auxiliary support member 160 axially supporting the other end of the body 141 and the other side of the cylinder 130 is additionally provided.

To describe with reference to FIG. 9, the auxiliary support member 160 is formed such that the outer circumference surface thereof corresponds to the assembly hole 115 so as to be inserted into the assembly hole 115 of the housing 110, and the inside thereof is formed to protrude farther than the inside of the support member 140 so as to be able to axially support the other side of the support member 140 and the other side of the cylinder 130.

The inside of the auxiliary support member 160 is formed to be spaced apart from the piston 120 so that the piston 120 may stably reciprocate without encumbrance.

In addition, the inside of the auxiliary support member 160 is formed to be spaced apart from the piston 120 so that the cylinder 130 of the piston 120 may be provided with the extension 131 and the outer circumferential surface of the extension 131 of the cylinder 130 is supported.

That is, the auxiliary support member 160 supports the housing 110 and the cylinder 130, the outside supporting the assembly hole 115 of the housing 110 and the inside supporting the extension 131.

In addition, the auxiliary support member 160 is axially compressed by the fixing member 150 mounted in the assembly hole 115 to elastically support the support member 140 in the axial direction.

In addition, the body 141 of the support member 140 may be formed such that the other end partially protrudes inward along the circumference or may be provided to surround the outer edge of the other end, rounded or chamfered, of the cylinder 130 as the body 141 is axially compressed by the fixing member 150.

Accordingly, the coupling stability between the support member 140 and the cylinder 130 is enhanced.

When the second end support 143 is a separate component and the auxiliary support member 160 is additionally provided, the cylinder 130 may be inserted into the support member 140 without spreading apart the other end of the support member 140.

That is, the support member 140, the cylinder 130, and the auxiliary support member 160 are inserted into the assembly hole 115 in order, and then, the fixing member 150 is mounted so that the assembly is facilitated.

In addition, the support member 140 and the auxiliary support member 160 are partially compressed in the axial direction when the fixing member 150 is mounted so that the support member 140, the cylinder 130, and the auxiliary support member 160 come into close contact to improve the coupling stability.

According to the embodiment of the present disclosure, there can be obtained the effects of reducing fuel leakage through a gap between a piston and a cylinder, preventing the piston from sticking to one side of the cylinder even when a lateral force is generated during an up/down operation of the piston, and reducing the operation loss caused by friction between the piston and the cylinder.

In addition, the up/down operation of the piston is guided through the support member and the cylinder so that the piston operates more stably and the discharge efficiency of the high pressure pump is enhanced.

All the components constituting the embodiments of the present disclosure are described as being combined or operating in combination thus far, but the present disclosure is not necessarily limited to these embodiments. That is, one or more of all the components may be selectively combined to operate within the scope of the object of the present disclosure.

The above description is only an illustrative description of the technical idea of the present disclosure, and various modifications and variations within the scope not deviating from the essential features of the present disclosure may be possible by those skilled in the art to which the present disclosure pertains. Therefore, the embodiments disclosed in the present disclosure are not intended to limit but to describe the technical ideas of the present disclosure, and the scope of the technical ideas of the present disclosure is not limited by these embodiments. The scope of protection of the present disclosure should be interpreted based on the following claims, and all technical ideas within the scope equivalent thereto should be construed as being included in the scope of the right of the present disclosure.

What is claimed is:

1. A high pressure pump, comprising:

a housing with a chamber formed inside and a flow control valve and a discharge check valve installed in the chamber;

a piston installed to reciprocate in an assembly hall formed in the housing to compress fuel in the chamber to a high pressure;

a cylinder forming a gap between an inner circumferential surface and the piston and guiding reciprocation of the piston; and a support member seated on a stepped surface of the housing to surround an outside of the cylinder and configured to elastically support the housing and the cylinder, wherein the support member includes:

a body formed in a cylindrical shape and inserted between the housing and the cylinder; and a first end support protruding inward along a circumference of the cylinder from one end of the body to support one side of the cylinder with a protruding end in close contact with the piston to support the housing and the piston.

2. The high pressure pump of claim 1, wherein the support member further includes a second end support protruding inward along the circumference from the body to support the cylinder with the protruding end spaced apart from the piston.

3. The high pressure pump of claim 2, wherein the cylinder includes a hollow-shaped extension formed to axially protrude from the cylinder and positioned between the second end support and the piston.

4. The high pressure pump of claim 3, further comprising a hollow-shaped fixing member mounted in an assembly hole to support the second end member in an axial direction of the piston, wherein the inner diameter of the fixing member is smaller than an outer diameter of the cylinder and larger than an outer diameter of the extension.

5. The high pressure pump of claim 1, further comprising an auxiliary support member formed in a hollow shape and inserted into the assembly hole to axially support the support member and the cylinder, the inner side being spaced apart from the piston.

6. The high pressure pump of claim 1, further comprising a fixing member mounted in the assembly hole to support in an axial direction of the piston an end of the support member opposite an end supported by the stepped surface.

7. The high pressure pump of claim 6, wherein the fixing member is provided with a space to the cylinder or the piston in the radial direction.

8. The high pressure pump of claim 1, wherein the assembly hole is formed by stepping from, and with a larger diameter than, the insertion hole of the housing to which the piston is installed with a gap, and is formed in a cylindrical shape with an axis of piston as a center axis.

* * * * *